United States Patent [19]

Chanel

[11] Patent Number: 4,809,486

[45] Date of Patent: Mar. 7, 1989

[54] APPARATUS FOR INJECTING A NEUTRAL GAS INTO RECEPTACLES OF IN PARTICULAR FOOD PRODUCTS

[75] Inventor: Arthur Chanel, St Remy, France

[73] Assignee: Fromageries Bresse-Bleu, France

[21] Appl. No.: 180,535

[22] Filed: Apr. 12, 1988

[30] Foreign Application Priority Data

Apr. 15, 1987 [FR] France ..... 87 05355

[51] Int. Cl.[4] ..... B65B 31/02; B65B 31/06

[52] U.S. Cl. ..... 53/510; 53/88; 53/276; 53/281

[58] Field of Search ..... 53/432, 468, 471, 473, 53/87, 511, 88, 97, 510, 266 R, 268, 276, 281

[56] References Cited

U.S. PATENT DOCUMENTS

| | | | |
|---|---|---|---|
| 2,519,353 | 8/1950 | Cassady | 53/88 X |
| 3,256,672 | 6/1966 | Palmer | 53/88 |
| 3,340,668 | 9/1967 | Bofinger | 53/432 X |
| 3,398,500 | 8/1968 | Inman | 53/432 |
| 3,545,160 | 12/1970 | Jantze et al. | 53/510 X |
| 3,714,760 | 2/1973 | Roberts et al. | 53/510 |
| 3,992,850 | 11/1976 | Vetter | 53/510 |
| 4,009,552 | 3/1977 | Schlachter | 53/510 X |
| 4,624,099 | 11/1986 | Harder | 53/432 |
| 4,729,204 | 3/1988 | Weiss | 53/88 |

*Primary Examiner*—Horace M. Culver

*Attorney, Agent, or Firm*—McGlew & Tuttle

[57] ABSTRACT

The apparatus comprises a rotary plate (1) on which are provided receptacle receiving means (2, 3, 4, 5) disposed at 90° to one another. The plate is driven in rotation in 90° steps by a motor-speed reducer unit (6) so that the receiving means pass in succession in front of a station for charging product into the bottoms of the receptacles, a station for laying lids of the receptacles, a station for welding the lids to the bottoms of the receptacles and a receptacle discharging station. The receiving means comprise means for maintaining the lids spaced away from the bottoms of the receptacles and means for injecting neutral gas between the lid laying station and the lid welding station.

12 Claims, 4 Drawing Sheets

APPARATUS FOR INJECTING A NEUTRAL GAS INTO RECEPTACLES OF IN PARTICULAR FOOD PRODUCTS

The present invention relates to an apparatus for injecting a neutral gas into receptacles of in particular food products.

A number of apparatus of this type are already known in the art for injecting for example nitrogen into packages of food products for improving the preservation of the latter.

However, the structure of these apparatus is such that they have several drawbacks in particular as concerns the rate of injection.

An object of the invention is therefore to overcome these problems by proposing an apparatus which is simple, reliable and of relatively low cost.

The invention therefore provides an apparatus for injecting a neutral gas into receptacles of in particular food products, said receptacles comprising a bottom and a lid and being essentially very shallow with the lid having a height at least equal to the depth of the bottom, said apparatus comprising a rotary plate on which are provided receptacle receiving means disposed at 90° to each other, said plate being driven in rotation in 90° steps by a motor-speed reducer unit so that the receptacle receiving means pass in succession in front of a station for charging a product in the bottom of the receptacles, a station for laying lids of the latter, a station for welding the lids of the receptacles to the bottoms of the latter and a receptacle discharging station, the receptacle receiving means comprising means for maintaining the lids of the receptacles at least partly spaced away from the bottoms of the latter between the lid laying station and the welding station for welding the lids to the bottoms of the receptacles, and means for injecting a neutral gas into the receptacles, neutral gas supply means being provided for supplying the injecting means between the lid laying station and the welding station.

The following description with reference to the accompanying drawings given by way of non-limitative examples will explain how the invention can be put into practice.

Figure 1:
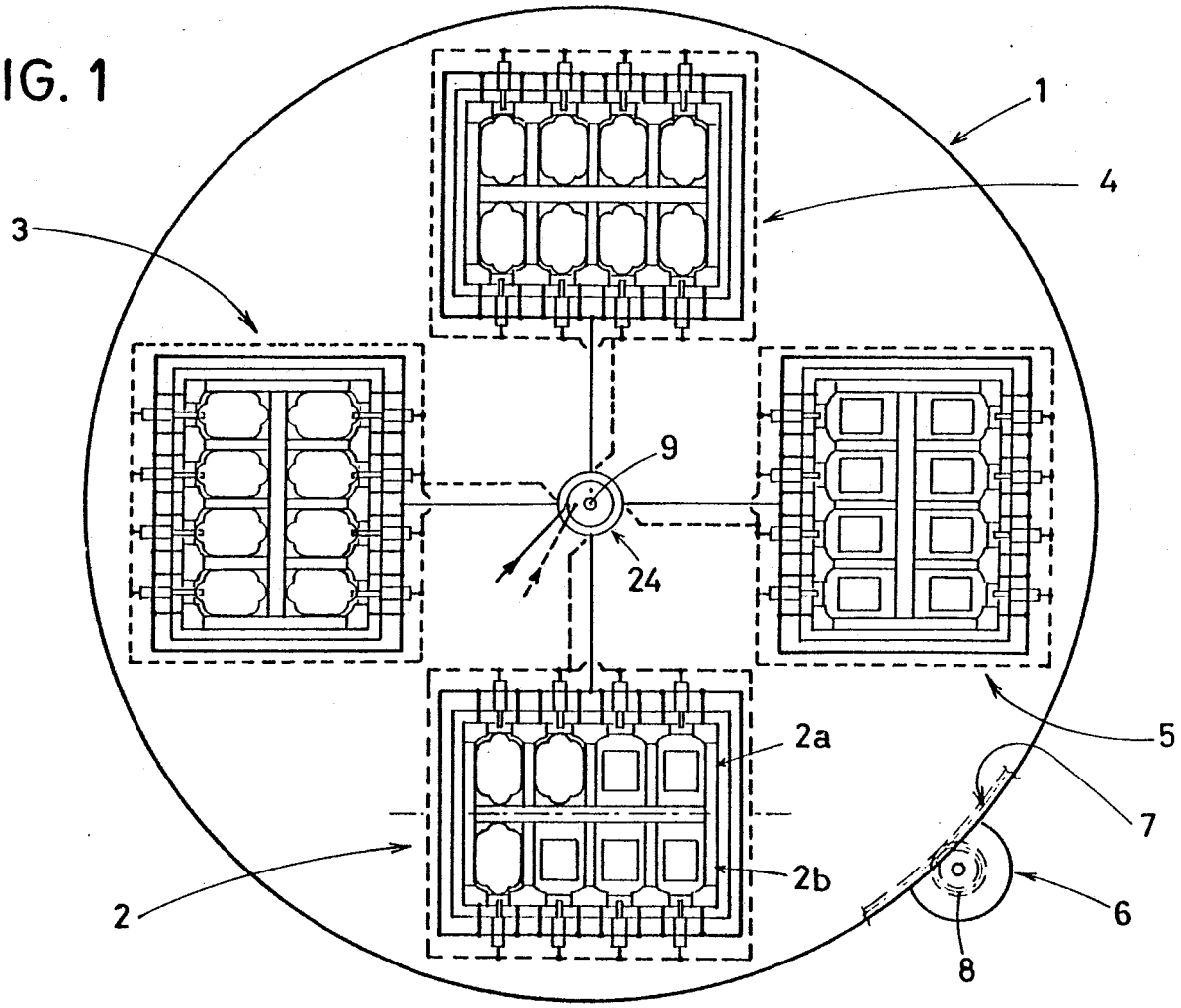
FIG. 1 is a top plan view of an apparatus according to the invention.

As can be seen in FIG. 1, an apparatus according to the invention comprises a rotary plate 1 on which are provided means 2, 3, 4 and 5 for receiving receptacles disposed at 90° to one another. These receiving means each comprise two rows, for example *2a*, *2b*, of four receptacle receiving cavities disposed on each side of an axis of symmetry. These cavities will be described in more detail hereinafter.

The rotary plate 1 is driven in rotation in 90° steps by a motor-speed reducer unit 6 in such manner that the receptacle receiving means pass in succession in front of a station for charging product in the bottoms of the receptacles in the receiving means, this charging station being for example located above the receptacle receiving means 2, then in front of a station for laying the lids of the receptacles, for example located above the receiving means 3, then in front of a station for welding the lids to the bottoms of the receptacles which is for example located above the receptacle receiving means 4, and lastly in front of a receptacle discharging station located for example above the receptacle receiving means 5, before returning to their starting position.

According to one embodiment, the rotary plate 1 includes on its periphery a ring gear 7 which cooperates with an output gear pinion 8 of the motor-speed reducer unit 6. As will be described in more detail hereinafter, the plate 1 is rotatably mounted on a fixed spindle 9 for centering and positioning the plate.

Figure 2:
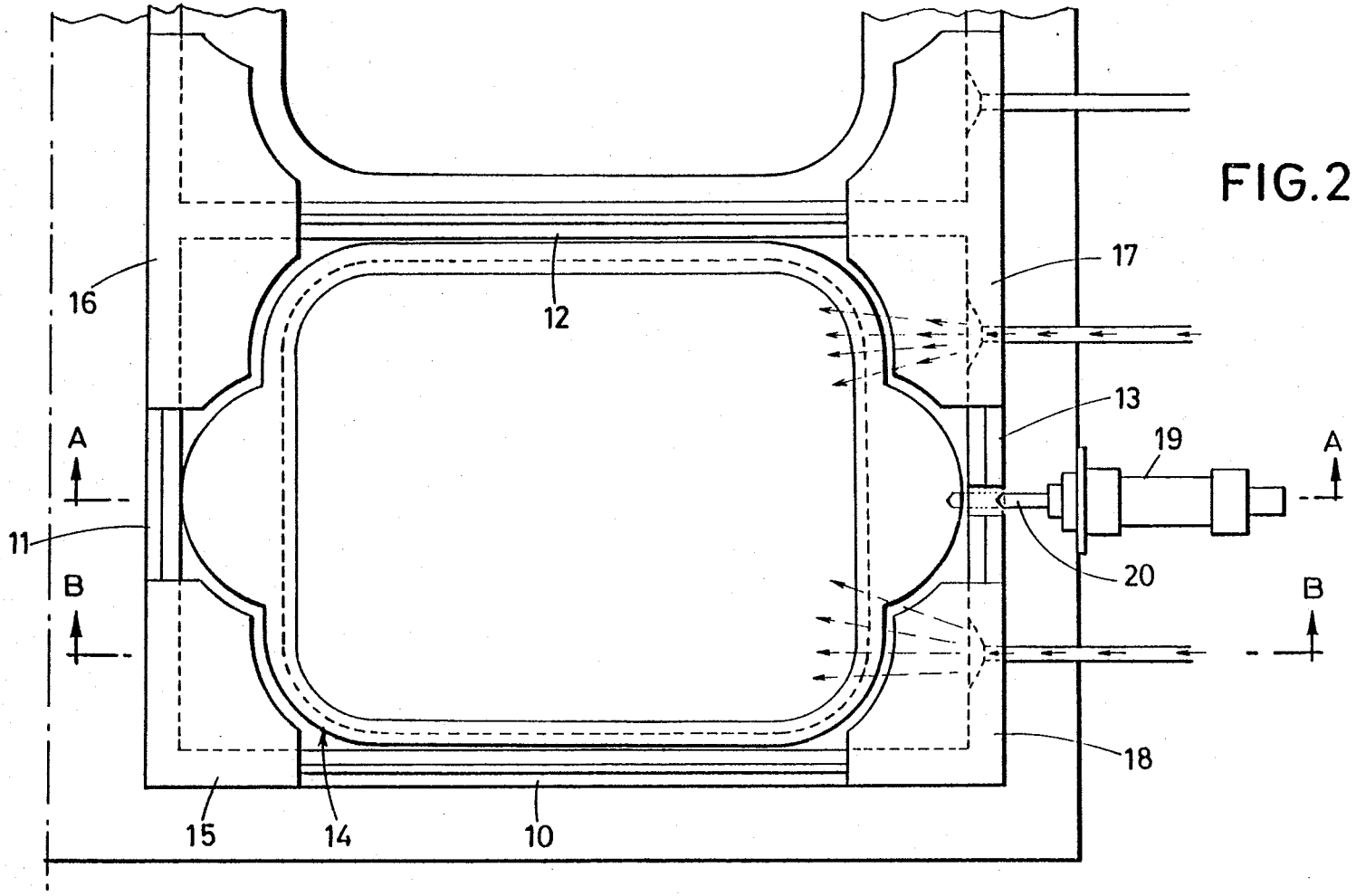
FIG. 2 is a top plan view of a cavity for receiving a receptacle which is part of the construction of an apparatus according to the invention.

As can be seen in FIG. 2 which is a top plan view to an enlarged scale of a cavity of the receptacle receiving means, this cavity has a generally rectangular shape defined by receptacle positioning and centering ledges 10, 11, 12 and 13. Positioning wedges 15, 16, 17 and 18 are also provided in each corner of the cavity.

Each cavity comprises means for maintaining the lid of the receptacle at least partly spaced away from the bottom of the latter between the lid laying station and the station for welding the lids to the bottoms of the receptacles to permit the injection of a neutral gas into the receptacles between these two stations.

Figure 3:
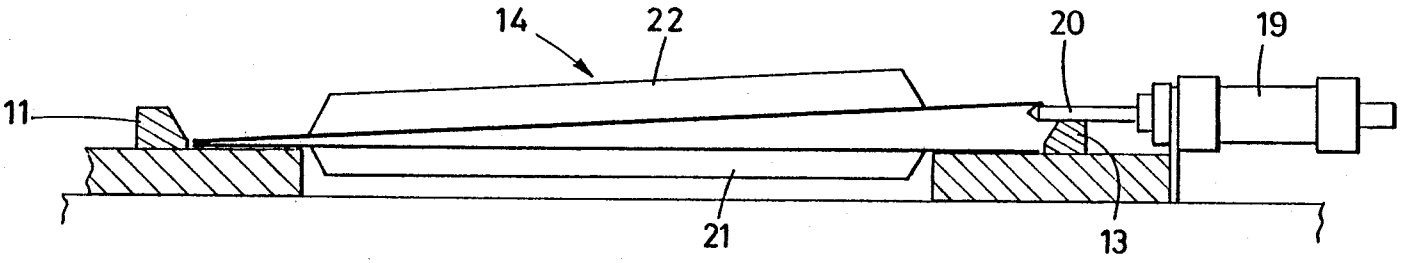
FIG. 3 is a sectional view taken on line A—A of FIG. 2.
Figure 4:
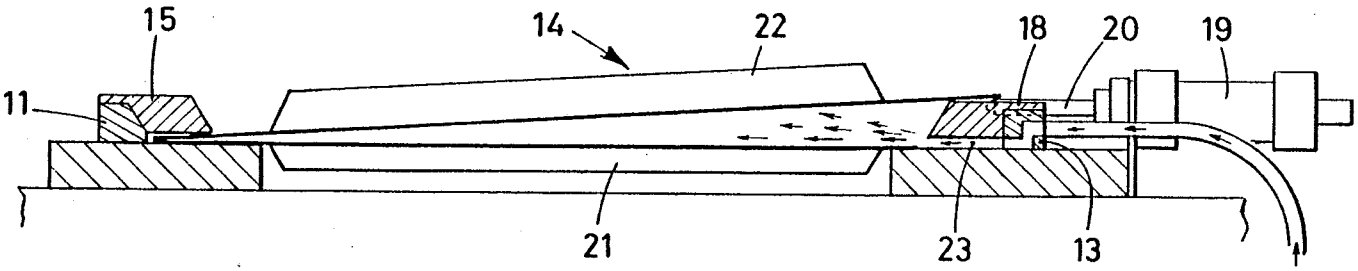
FIG. 4 is a sectional view taken on line B—B of FIG. 2.

As shown in FIGS. 2, 3 and 4, the means for maintaining the lids spaced away from the bottoms of the receptacles are formed by a jack 19 whose rod 20 is mounted to be movable between an operative position shown in these figures in which it extends above a part of the bottom 21 (FIGS. 3 and 4) of the receptacle 14 for preventing the lid 22 of the latter from completely covering the bottom.

The ledges 10, 11, 12 and 13 and the wedges 15, 16, 17 and 18 have inclined surfaces for guiding the bottom and the lid of the receptacle when they are placed in the cavity and therefore provide a precise positioning of these parts with respect to the rod of the jack and to the neutral gas injecting means.

As can be seen in particular in FIG. 4 the neutral gas injecting means are formed by injection nozzles, for example 23, provided below the jack 19 so as to have access to the interior of the receptacles.

Advantageously, each aavity has two injection nozzles provided in the positioning wedges 17 and 18 located on each side of the jack 19 so as to obtain a good sweeping of the interior of the receptacle.

These neutral gas injecting means and the means for maintaining the lids of the receptacles spaced away from the botooms are connected to supply and control means 24 (FIG. 1) disposed at the centre of the rotary plate and connected, on one hand, to a source of air and neutral gas under pressure and, on the other hand, to the injecting means and the previously described jacks.

In FIG. 1, the connections in dotted lines between the supply and control means 24 and the rest of the apparatus represent the pipes supplying air under pressure to the jacks of the cavities, while the full lines represent the pipes supplying neutral gas to the injection nozzles of the lastmentioned supply pipes.

Figure 5:
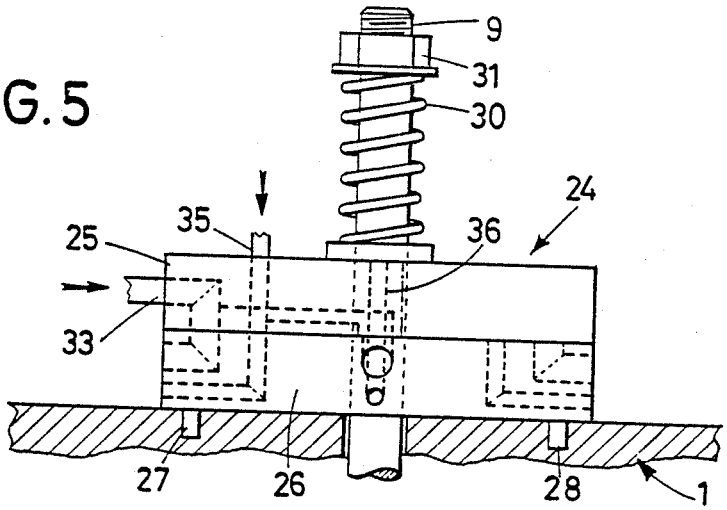
FIG. 5 is a side elevational view of supply and control means which are of the apparatus according to the invention.
Figure 6:
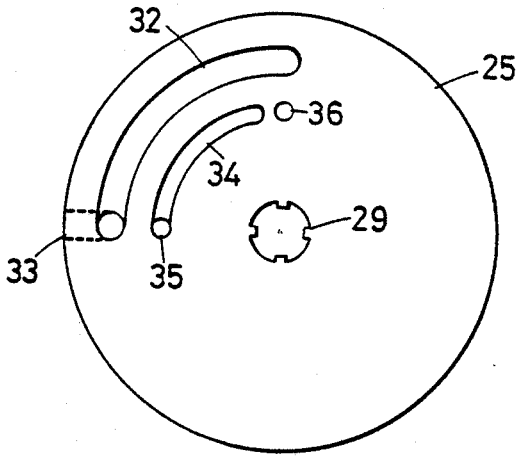
FIG. 6 is a top plan view in transparency of a first disk which is part of are the supply and control means shown in FIG. 5.
Figure 7:
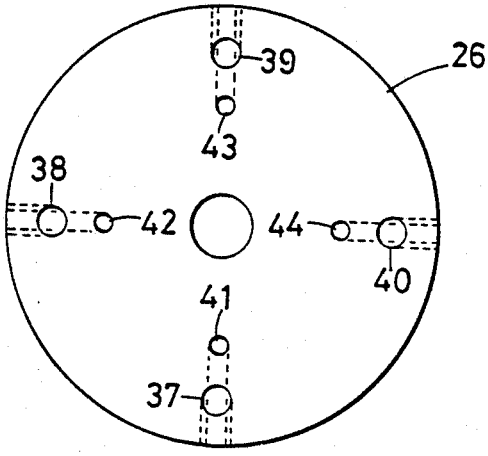
FIG. 7 is a top plan view of a second disk which is part of the supply and control means of FIG. 5.

The supply and control means 24 are shown in more detail in FIGS. 5, 6 and 7. These means comprise two disks 25 and 26 located one above the other, the disk 26 being connected to rotate with the plate 1 and the disk 25 being keyed against rotation on the spindle 9 centering the plate.

The disk 26 has for example two pins 27, 28 adapted to engage in corresponding recesses in the plate 1 for locking these two parts in rotation. The disk 25 has for example splines 29 (FIG. 6) adapted to cooperate with means of complementary shape of the fixed spindle 9 for keying this disk against rotation while allowing it to move axially along the spindle. Elastically yieldable means 30, constituted for example by a coil spring disposed around the spindle 9 and having one end bearing against a nut 31 screwed on a screwthreaded portion of the spindle, elastically yieldably biases the disks against each other.

As can be seen more particularly in FIG. 6, the disk 25, fixed in rotation, comprises on the surface thereof facing the other disk, a first groove 32 extending in an arc of a circle through an angle of roughly 90° at a first distance from the axis of the spindle. This first groove 32 is connected to the source of neutral gas through an orifice 33 which opens onto the periphery of this disk.

The disk 25 also has a second groove 34 which extends in an arc of a circle through an angle of about 82° parallel to the first groove and at a second distance from the axis of the spindle. The second groove 34 is connected to the source of air under pressure through a orifice 35 opening onto the surface of the disk 25 opposed to the surface in which the grooves are provided.

The disk 25 is also provided with a throughway duct 36 located at the second distance from the axis of the spindle adjacent to one of the ends of the second groove 34 and adapted to constitute a duct for the connection of the cavity jacks to the exhaust, as will be described hereinafter.

The first groove, the second groove and the duct 36 are provided in the same quarter of the area of the disk.

The disk 26 (FIG. 7) has two series of four ducts, respectively 37, 38, 39, 40 and 41, 42, 43 and 44, one of the ends of which opens onto the surface of the disk facing the other disk at 90° to each other, the other end of these ducts opening onto the periphery of the disk. The ducts of the first series, i.e. the ducts 37, 38, 39 an 40, open out at the first distance from the axis of the spindle and the ducts of the second series, i.e. the ducts 41, 42, 43 and 44, at the second distance so that the ducts of the first series encounter, when the rotary disk moves relative to the fixed disk, the first groove 32 and the ducts of the second series encounter the second groove 34 and the duct 36.

The, ducts of th first series are connected to the neutral gas injecting means of the cavities while those of the second series are connected to the jacks of the cavities.

To illustrate the operation of the apparatus, it will be assumed that the ducts 37 and 41 (FIG. 7) of the rotary disk 26 are respectively connected to the neutral gas injecting means and to the jacks of the receptacle receiving means 2 (FIG. 1).

A cycle of operation commences by the charging of product into the bottoms of the receptacles in the receiving means. In this position, the ducts 37 and 41 of the disk 26 are located in front of solid parts of the disk 25, the rods of the jacks are retracted to permit the introduction of the bottoms of the receptacles in the cavities and the neutral gas injecting means are not supplied with gas.

When the charging a product into the bottoms of the receptacles has finished, the motor-speed reducer unit 6 is actuated and the rotary plate turns through a quarter of a turn and drives the disk 26. The duct 41 of the latter is then positioned in front of the second groove 34 of the fixed disk so that the jacks of the receiving means 2 are supplied with the compressed air and the rods of the latter are shifted to their operative position.

At the same time, the duct 37 reaches a position in front of the first groove 32 so that the neutral gas injecting means are supplied with neutral gas and the gas sweeping commences, while the lids of the receptacles rest against the rods of the jacks.

The motor speed reducer unit 6 is again actuated and the plate turns through another quarter of a turn. During this rotation, the duct 37 of the disk 26 is moved in front of the first groove 32 so that the sweeping of neutral gas is pursued. The recess 41 of the disk 26 also moves in front of the second groove 34 and the rods of the jacks remain in their operative position. At the end of this rotation, the recess 41 of the disk 26 reaches the position in front of the exhaust duct 36 so that the rods of the jacks are retracted and release the lids of the receptacles. The welding of the lids to the bottoms of the receptacles is then carried out by any known means and the plate then effects another quarter of a turn. The supply of the injecting means is then cut off and the receiving means 2 move to the receptacle discharging station. When the receptacles have been discharged, the plate effects another quarter of a turn and is then placed in the first-described position.

The various means for charging product into the bottoms of the receptacles, laying the lids on the latter, welding the lids and discharging the receptacles may be constituted by any known means and therefore will not be described in detail.

As will be understood, other embodiments may be envisaged. For example, the single-acting jacks employed may be replaced by other means performing the same function. Likewise, the means for driving the rotary plate may be constituted by devices other than the described motor-speed reducer unit.

The apparatus according to the invention may also be used for injecting a neutral gas other than nitrogen into receptacles containing products other than food products.

I claim:

1. An apparatus for injecting a neutral gas into receptacles of in particular food products, said receptacles comprising a bottom and a lid and being essentially very shallow with the lid having a height at least equal to the depth of the bottom, said apparatus comprising a rotary plate having an axis of rotation, receptacle receiving means disposed at 90° to one another about said axis and carried by said plate, a motor-speed reducer unit drivingly connected to said plate for driving said plate in rotation in 90° steps about said axis so that the receptacle receiving means pass in succession in front of a station for charging product into the bottoms of the receptacles, a station for laying the lids on the bottoms of the receptacles, a station for welding the lids to the bottoms of the receptacles, and a receptacle discharging station, said receptacle receiving means comprising means for maintaining the lids of the receptacles at least partly spaced away from the bottoms of the receptacles between the lid laying station and the lid welding station, the apparatus further comprising means for injecting neutral gas into the receptacles, means for supplying neutral gas to the injecting means between the lid laying station and the lid welding station, and said receiving means comprising cavities each of which cavities includes means for guiding and centering the corresponding receptacle, a respective one of said means for maintaining the lid spaced away from the bottom of the receptacle and a respective one of said means for injecting neutral gas into the receptacle.

2. An apparatus according to claim 1, wherein each of the receiving means comprises two rows of four cavities disposed on each side of an axis of symmetry.

3. An apparatus according to claim 1, wherein the means for maintaining the lids spaced away from the bottoms of the receptacles each comprise a jack having a rod mounted to be movable between an operative position in which it extends over a part of the bottom of a receptacle and a retracted position, and control means for moving said rod.

4. An apparatus according to claim 1, wherein the injecting means comprise for each cavity two injection nozzles disposed below the means for maintaining the lid spaced away from the bottom of the respective receptacle.

5. An apparatus according to claim 4, comprising wedges for positioning the respective receptacle disposed on each side of the means for maintaining the lid spaced away from the bottom of the receptacle, said injection nozzles being provided in said wedges.

6. An apparatus according to claim 1, comprising a fixed centering spindle located on said axis and on which spindle said plate is rotatively mounted, and a ring gear provided on the periphery of said plate, the motor-speed reducer unit having an output gear pinion engaged with said ring gear.

7. An apparatus according to claim 1, wherein the means for maintaining the lids spaced away from the bottoms of the receptacles each comprise a jack having a rod mounted to be movable between an operative position in which it extends over a part of the bottom of a receptacle and a retracted position and control means for moving said rod, the apparatus further comprising a fixed centering spindle located on said axis and on which spindle said plate is rotatively mounted, and a ring gear provided on the periphery of said plate, the motor-speed reducer unit having an output gear pinion engaged with said ring gear, said supply means and said control means comprising two disks disposed one above the other, a first disk of said disks being connected to rotate with the rotary plate and a second disk of said disks being prevented from rotating relative to said fixed centering spindle, the second disk comprising on a surface thereof facing the first disk a first groove extending in an arc of a circle through an angle of substantially 90° about said axis at a first distance from said axis for connection to a source of neutral gas under pressure, a second groove extending in an arc of a circle through an angle of substantially 82° in a direction parallel to the first groove and at a second distance from said axis for connection to a source of air under pressure, a throughway duct in the second disk located at the second distance from said axis adjacent to an end of the second groove, the first groove, the second groove and the duct being provided in the same quarter of the area of the disk, the first disk comprising two series of four ducts opening onto a surface of the first disk facing the second disk and spaced 90° apart from one another about said axis, the ducts of the first series opening out at the first distance from said axis and being connected to the neutral gas injecting means of the cavities, while the ducts of the second series open out at the second distance from said axis and are connected to the jacks of the receptacle receiving cavities.

8. An apparatus according to claim 7, wherein the ends of the ducts of the first disk open onto the periphery of the first disk.

9. An apparatus according to claim 7, wherein the first disk includes pins engaged in recesses in said plate.

10. An apparatus according to claim 7, wherein the second disk comprises splines cooperative with means of complementary shape integral with the spindle.

11. An apparatus according to claim 7, comprising elastic biasing means for biasing the second disk toward the first disk.

12. An apparatus according to claim 11, wherein the elastic biasing means comprise a coil spring disposed around the spindle and having one end bearing against a nut screwed on a screw-threaded portion of the spindle and another end bearing against the second disk.

* * * * *